US007330097B2

(12) United States Patent
Takeda

(10) Patent No.: US 7,330,097 B2
(45) Date of Patent: Feb. 12, 2008

(54) DIRECT CURRENT CUTOFF SWITCH

(75) Inventor: Hideaki Takeda, Saitama (JP)

(73) Assignee: Uchiya Thermostat Co., Ltd., Misato (JP)

( * ) Notice: Subject to any disclaimer, the term of this patent is extended or adjusted under 35 U.S.C. 154(b) by 287 days.

(21) Appl. No.: 10/517,164

(22) PCT Filed: May 22, 2003

(86) PCT No.: PCT/JP03/06412

§ 371 (c)(1),
(2), (4) Date: Dec. 7, 2004

(87) PCT Pub. No.: WO03/105172

PCT Pub. Date: Dec. 18, 2003

(65) Prior Publication Data

US 2005/0174211 A1 Aug. 11, 2005

(30) Foreign Application Priority Data

Jun. 11, 2002 (JP) ..... 2002-169761

(51) Int. Cl.
*H01H 37/32* (2006.01)
*H01H 37/54* (2006.01)

(52) U.S. Cl. ..... 337/102; 337/103; 337/104; 361/103; 361/105

(58) Field of Classification Search ..... 337/102–104; 361/103, 105
See application file for complete search history.

(56) References Cited

U.S. PATENT DOCUMENTS 3,840,834 A * 10/1974 Obenhaus et al. ..... 337/79
4,862,132 A * 8/1989 Hollweck ..... 337/102
4,878,038 A * 10/1989 Tsai ..... 337/107
5,309,131 A * 5/1994 Hofsass et al. ..... 337/102
5,607,610 A * 3/1997 Furukawa ..... 219/505
6,396,381 B1 5/2002 Takeda

FOREIGN PATENT DOCUMENTS

| | | |
|---|---|---|
| JP | 51-12697 | 4/1976 |
| JP | 56-169344 | 12/1981 |
| JP | 2001-35330 | 2/2001 |
| WO | WO 97/10636 | 3/1997 |
| WO | WO 99/10903 | 3/1999 |

* cited by examiner

*Primary Examiner*—Anatoly Vortman
(74) *Attorney, Agent, or Firm*—Greer, Burns & Crain, Ltd.

(57) ABSTRACT

In a direct current cutoff switch1, a PTC 5, which is a non-linear resistor, is parallel connected to a contact circuit composed of a fixed contact 4-2 and a movable contact 8-2 via electrodes 5-1. When the switch is closed, no current flows in the PTC 5 with a prescribed resistance value at 25° C., since voltage between both the electrodes 5-1 is almost "0". When the switch is opened in order to cut off current, the contacts form a closed circuit since the PTC 5 is parallel inserted between the fixed contact 4-2 and the movable contact 8-2. For this reason, it is difficult for surge voltage to occur and an arc hardly occurs between both the contacts. The PTC 5 instantaneously heats due to passing current, reduces the resistance value and passes peak current. Then, the resistance value rises and becomes stable in a high value such that weak current which is negligible at 42V, which is rated voltage. Thus, current is substantially cut off.

6 Claims, 7 Drawing Sheets

( a )

( b )

14

| 14-1 SAMPLE No. | 14-2 RESISTANCE VALUE AT 25℃ (Ω) | 14-3 CURRENT VALUE AT 25℃ (A) | 14-4 POSITION OF PEAK CURRENT (V) | 14-5 POSITION OF LOWER PEAK (V) |
|---|---|---|---|---|
| No. 1 | 7 | 0.013 | 1.2 | 30 |
| No. 2 | 15 | 0.0105 | 1.8 | 40 |
| No. 3 | 30 | 0.0071 | 2.7 | 110 |
| No. 4 | 50 | 0.00505 | 4 | 170 |
| No. 5 | 30 | 0.00205 | 3 | 83 |
| No. 6 | 50 | 0.0022 | 4 | 60 |
| No. 7 | 100 | 0.0016 | 4.5 | 60 |
| No. 8 | 200 | 0.0012 | 8 | 60 |
| No. 9 | 300 | 0.001 | 9.8 | 60 |
| No. 10 | 5000 | 0.00022 | 40 | 270 |
| No. 11 | 10000 | 0.00017 | 53 | 280 |

FIG. 5

DIRECT CURRENT CUTOFF SWITCH

TECHNICAL FIELD

The present invention relates to a direct current cutoff switch, more particularly to a direct current cutoff switch for preventing contacts from melting by reducing the occurrence time of the contact-opening arc of a high-voltage current circuit and reducing its damage.

BACKGROUND ART

There is conventionally a switch used for the opening/closing of a direct current circuit in the electrical equipment of automobiles, and electronic products driven by a battery or the like. Power supply voltage for driving the electrical equipment of the conventional automobile in which such a switch is used is mainly DC 12V or DC 24V, and power supply voltage for portable electronic equipment using a battery is also mainly DC 12V.

Even motor-driven tools required to output high power can be sufficiently driven by DC 18V or 24V, and the conventional switch has been used as a switch for such a power supply unit without any modifications and without any trouble.

However, recently, high power has been demanded for the power supply unit of such motor-driven devices used by high-voltage electrical equipment in automobiles, devices using a battery, and electrical home appliances, such as an electrical vacuum cleaner whose performance is reinforced; and also products such as a motor-driven bicycle and the like. In accordance with the required high output of such a power supply unit, a high-voltage power supply unit has been needed.

Currently, the generally-called high-voltage of a power supply unit used for such products 30V or more, and its upper limit in the international rating is 42V. Voltage needed to realize such driving output required in a variety of the above-mentioned electrical products is considered to be 30V through 42V. Direct current obtained by rectifying AC mains power voltage used in such devices is far higher and amount to 140V or 300V.

A switch used with such a circuit having a high-voltage/large-current that is used to open and close a high voltage power supply unit is needed.

The switch of the above-mentioned conventional current circuit has one problem, which is the melting of contacts due to surge voltages.

For example, in the case of direct current, it is known that when cutting off large current, the influence of an arc generated between the contacts of a switch to be opened increases as the voltage of the power supply unit increases. For example, it is known that if a power supply unit is closed by the conventional switch when the power supply voltage is DC 42V and even when current is approximately 10A, generally voltage at the time of closing contacts becomes higher than voltage at the time of opening the contacts, and that an arc tends to occur. Not only an arc tends to occur, but also the occurrence time of an arc becomes longer.

If a large current of, for example, 50A is used even when voltage is close to 30V or if such a current circuit is cut off by the conventional switch when a highly inductive load is driven using a coil, such as a motor, a relay and the like, an arc tends to occur and its occurrence time increases. This is because high surge voltage occurs if such high voltage/large current is cut off.

If a distance between contacts to be opened at the time of cutting off current is short or if an arc between contacts increases beyond a limit, such phenomenon often becomes remarkable, and an arc generated between the contacts often does not extinguish instantaneously and continues for several tens of milli-seconds. If an arc continues for several tens of milli-seconds like this, the arc generates high heat. As a result, the circuit is short-circuited by melting the contacts and generating fusion between the contacts. Alternatively, even if the contacts are maintained open, a dielectric member around the contacts often melts down, produces smoke or fires by heat, which is a problem. If an opened distance between the contacts of a switch is widened, at least the problem of contact fusion can be solved. The occurrence period of an arc can also be shortened. However, even if the occurrence period is shortened, an arc occurs immediately after opening the contacts. Therefore, the problem of contact meltdown cannot be solved. Specifically, every time current is cut off, the contacts melt down and deform, and accordingly, the life of switch is shortened.

Widening the opened distance between the contacts of a switch means the large-scaled structure of the main body of a switch. In the recent trend of the miniaturization of a motor-driven part in all electronic devices, a large-scaled switch must be avoided first of all.

However, as a method for preventing or suppressing sparks between the contacts, inserting a resistor between the contacts is also known. However, the value of a resistor sufficient to reduce current so as to prevent or suppress sparks is very low. If such a low resistance value is connected even after the contacts are opened, the accumulated amount of leak current becomes too large to neglect and uneconomical.

A variety of devices for absorbing surge voltage (or surge current) are also known. For example, for the surge voltage absorbing devices, a varister, a silicon surge absorber, a gas arrester using discharge and the like, are known. However, any of these devices is used to protect circuits driven by the above-mentioned voltage in use from abnormal surge voltage by absorbing high surge voltage at the time of an emergency, and are different from voltage in use, and are not used to absorb surge voltage that is almost the same as voltage used at the time of the opening/closing of a switch.

Since the surge voltage absorbing devices are used for such a purpose, in the functional characteristic of the surge voltage absorbing device, the range of voltage in use is narrowed against surge limiting voltage, and a difference between this narrow-range voltage in use and surge limiting voltage is used as a safety margin.

Therefore, even if a surge voltage absorbing device which is used to absorb high voltage at the time of emergency, which is different from the voltage in use, has a characteristic in which a safety margin is set between voltage in use and surge limiting voltage, and is inserted between the contacts of a normal switch, the surge voltage absorbing device does not operate. That is, the surge device cannot fulfill a function to absorb surge voltage, since surge voltage at the time of the opening/closing of the switch is almost the same as the voltage in use.

As one of devices for preventing excessive current, a positive temperature coefficient (PTC) is also known besides the above-mentioned devices. The PTC has a characteristic that even if initially large current flows, it is attenuated and suppressed at a weak level.

Therefore, the PTC is used to prevent excessive current, but also is used as a heating element whose temperature rapidly rises. The PTC is also used as a non-contact switch for supplying equipment which requires large current only initially, such as the magnetic neutralizing coil of a color TV set, with current or for energizing a motor. In any case, the PTC has never been used as a surge voltage absorbing device at the time of cutting off current, not has it been considered like that.

Since generally a surge voltage absorbing device absorbs surge voltage by reducing a resistance value by self-heating, when using higher voltage, if far higher excessive voltage is applied, in the worst case, thermal runaway occurs and self-destruction is caused. For this reason, there is a possibility that a circuit to be protected may be short-circuited. Therefore, from this point of view, the conventional surge voltage absorbing device has been used simply to absorb surge voltage far higher than power supply voltage generated in the contacts of a switch.

An object of the present invention is to provide a small-size switch, relay type or thermal protector type, for safely cutting off large direct current with high-voltage without fusing or damaging its contacts in order to solve the conventional problems.

DISCLOSURE OF INVENTION

The direct current cutoff switch in the preferred embodiment of the present invention comprises a conductive fixed member and a conductive movable member between which a dielectric member is inserted. The fixed member comprises a fixed contact which is formed in a prescribed position and is connected to a terminal in order to be connected to an external circuit. The movable member comprises a movable contact which is formed in a position opposing the fixed contact, is connected to a terminal in order to be connected to the external circuit and is structured so as to push up the movable contact against the fixed contact or open the contact. By operating the movable contact so as to separate it from the fixed contact which the movable contact touches to open the contact, direct current which flows between the terminals connected to the external circuit is cut off. The direct current cutoff switch comprises a non-linear resistor which takes an arbitrary cylinder shape, comprises an electrode on each of the top surface and the bottom surface of the cylinder and is parallel connected to a contact circuit composed of the fixed contact and the movable contact via these electrodes. The non-linear resistor has a characteristic that has a resistance value fluctuating area indicating the minimum resistance value while inter-contact voltage shifts from 0V to the power voltage when the direct current is cut off by the opening of the movable contact.

In this direct current cutoff switch, for example, the above-mentioned non-linear resistor is a PTC, and contact opening voltage at the time of cutting off the above-mentioned large direct current by opening the above-mentioned movable contact is located in the range of 28V to 48V.

The PTC has, for example, a voltage/current characteristic where the upper limit of the range where no thermal runaway occurs or a lower peak value is 80V or more. In this case, for example, the position of peak current against voltage in the range where no thermal runaway occurs is located in the range of 2V to 20V.

It is preferable for the above-mentioned external circuit to be a circuit with the rating of DC 42V or a circuit for driving inductive load.

The above-mentioned movable member can be driven, for example, by a bi-metal. In this case, it is preferable for the external circuit to be the charging side circuit of a 28V or more secondary battery pack or a charging/discharging circuit, and also to be a rated circuit whose opening voltage generated by the opening of the movable contact at the time of charge or at the time of charge/discharge does not exceed 50V. Furthermore, in this case, it is preferable in the PTC, for example, for Tc (Curie temperature) to be set in a value higher than the operating temperature of the bi-metal.

The movable member can also be driven by an electromagnetic coil, for example.

The non-linear resistor is provided between the fixed contact or the movable contact and the above-mentioned connection terminal unit, for example, and an arc generated between contacts at the time of the opening of the movable contact is prevented from continuing for two or more milli-seconds.

The non-linear resistor can also be a PTC, and, for example, the contact opening voltage at the time of the cutoff of the large direct current, generated by the opening of the movable contact can also be set in the range of 130V to 310V.

As described above, according to the present invention, since a PTC whose voltage/current characteristic and temperature characteristic are especially set is parallel connected to the contact circuit of the switch, a closed circuit is formed and it is difficult for surge voltage to occur even if high-voltage current is cut off by opening the contacts of the switch. Then, the PTC passes through the minimum resistance area to complete the current cutoff operation. Thus, direct current with 30V through 50V or higher voltage of 130V through 310V can be rapidly and certainly cut off without setting a distance between contacts to be opened wide. Accordingly, the miniaturization of a switching mechanism can be realized, the recent miniaturization of electronic equipment can be easily realized and its usage can be extended, which is convenient.

Since no arc occurs between contacts, the contacts can be prevented from melting. Accordingly, a highly-reliable long-life high-voltage direct current cutoff switch can be provided.

BRIEF DESCRIPTION OF DRAWINGS

FIG. 3A shows a state where the switch is closed, and FIG. 3B shows a state where the switch is open.

FIG. 5 is a table in which the major characteristics of each PTC obtained from the voltage/current characteristic diagram are indicated by numeric values for the purpose of easy reading.

FIG. 7A shows its open contact state, and FIG. 7B shows its closed contact state.

CODES

Figure 1:
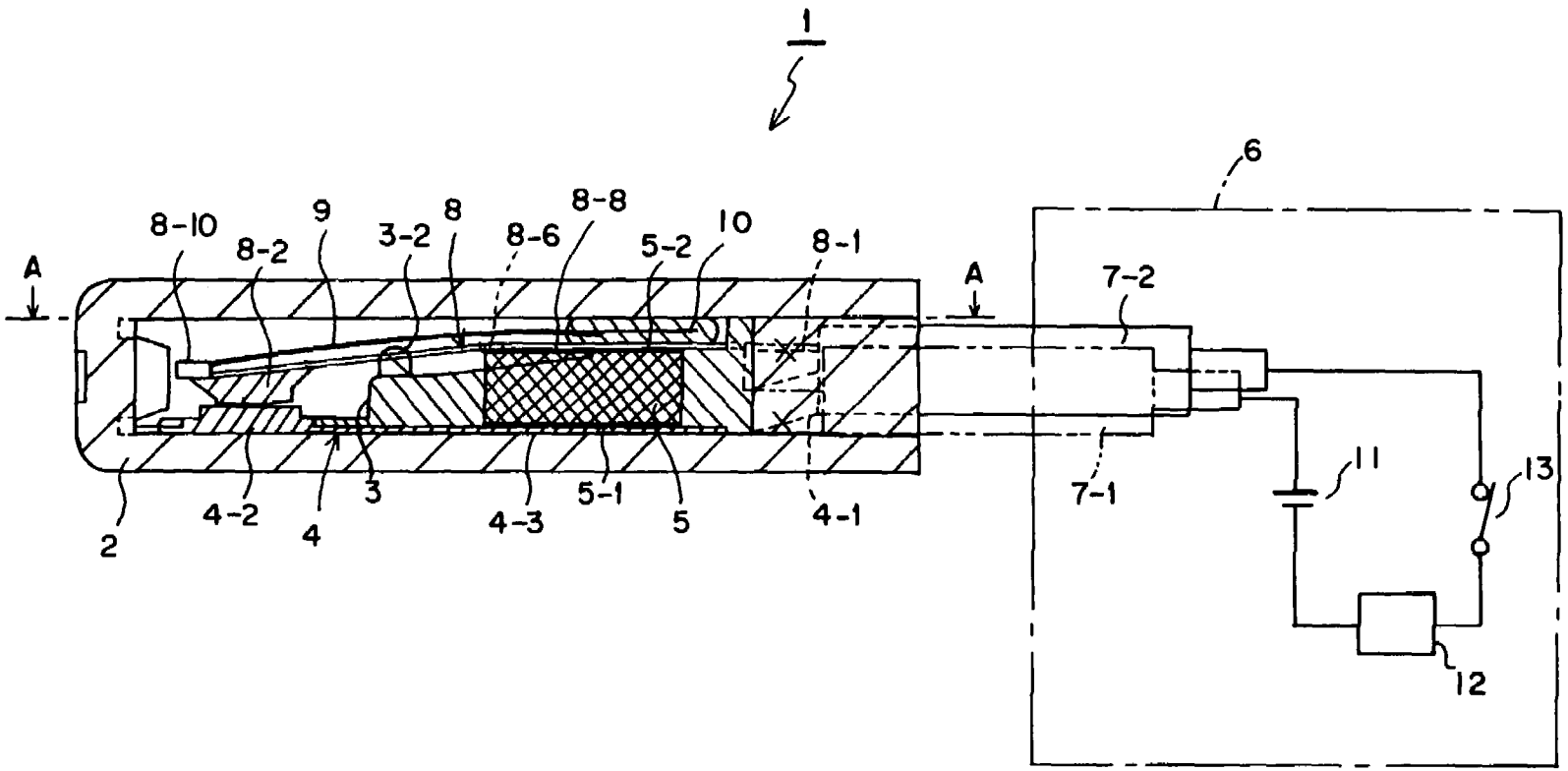
FIG. 1 shows the sectional side view of a thermostat as the direct current cutoff switch in one preferred embodiment of the present invention and an external circuit connected to this thermostat.

1 Thermostat
2 Housing
3 Support members
  3-1 Slope
  3-2 Bi-metal fulcrum projection
  3-3, 3-3 Catch projection
4 Fixed plate
  4-1 Connection terminal unit
  4-2 Fixed contact
  4-3 Connection surface
5 PTC
  5-1,5-2 Electrode
6 External circuit
7 (7-1,7-2) Connection terminal
8 Movable plate
  8-1 Connection terminal unit
  8-2 Movable contact
  8-3,8-3 Catch cut
  8-4 Fixed unit
  8-5 Fold
  8-6 Forked connection unit
  8-7 Movable unit
  8-8 Inner end of fixed unit
  8-9 Connect cut
  8-10 Bimetal engaging nail
  8-11 Bimetal fulcrum projection through hole
9 Bi-metal
10 Fixed plate
  10-1,10-1 Catch cut
11 Power supply unit
12 Load
13 Power switch
14 Table
  14-1 Field of sample No.
  14-2 Field of Resistance value at 25° C.
  14-3 Field of current at 25° C.
  14-4 Field of peak current position
  14-5 Field of lower peak position
15 Arc
16 Electro-magnetic relay

BEST MODE FOR CARRYING OUT THE INVENTION

The preferred embodiments of the present invention are described below with reference to the drawings. The direct current cutoff switch of the present invention embeds a PTC with a special characteristic, which is described later.

FIG. 1 shows the sectional side view of a thermostat as the direct current cutoff switch in one preferred embodiment of the present invention and an external circuit connected to this thermostat.

Figure 2:
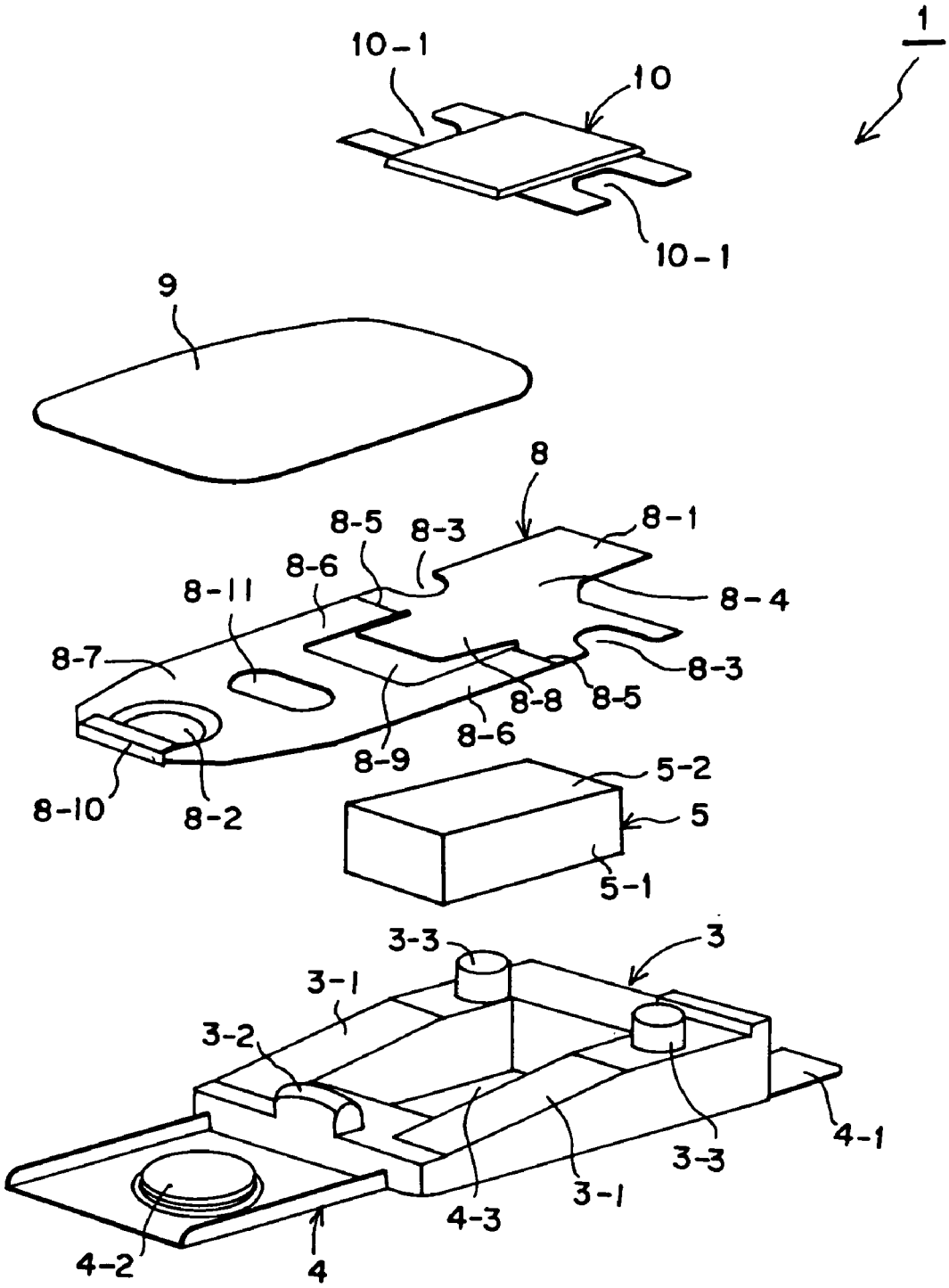
FIG. 2 is an exploded perspective illustration showing the internal structure of the thermostat.

FIG. 2 is an exploded perspective illustration showing the internal structure of the thermostat.

As shown in FIGS. 1 and 2, first, a thermostat 1 comprises a housing 2, a frame-shaped support member 3 fixed on one inner wall surface of the housing and a fixed plate 4 as an inductive fixed member inserted between the base of the support member and the inner wall surface of the housing 2. In the frame of the support member 3, a quadrangular prism-shaped PTC 5 as a non-linear resistor is accommodated.

The shape of this PTC 5 is not limited to a quadrangular prism, and it can be an arbitrary prism, such as a triangular prism, a multangular prism including quinquangular or more prisms, a cylinder or the like.

The fixed plate 4 comprises a connection terminal unit 4-1 formed to be connected to one terminal 7-1 of the connection terminal 7 (7-1, 7-2) of an external circuit 6 and a fixed contact 4-2 formed in a prescribed position (in FIG. 1, in the neighborhood of an end opposing the connection terminal unit 4-1). The fixed plate 4 further comprises a connection surface 4-3 exposed to the lower opening of the frame-shaped support member 3. This connection surface 4-3 is connected to one electrode (lower) 5-1 of the PTC 5.

On the top surface on each side (both sides in a direction orthogonal to a line connecting the connection terminal unit 4-1 and fixed contact 4-2 of the fixed plate 4) of the support member 3, a slope 3-1 which tilts downward from the middle toward the fixed contact 4-2 is formed. At the center of the top surface of a frame end connected to the end of this slope 3-1, a bi-metal fulcrum projection 3-2 is formed. On a surface on both the sides which does not tilt, a movable plate, which is described later and a catch projection 3-3 which determines their positions by catching a clamp plate are formed.

As shown in FIG. 2, a movable plate 8 is disposed overlapping these fixed plate 4, support member 3 and PTC 5, as an inductive movable member. The movable plate 8 comprises a connection terminal unit 8-1 formed to be connected to the other terminal 7-2 of the connection terminal 7 of the external circuit 6 and a movable contact 8-2 formed in the position opposing the fixed contact 4-2 of the fixed plate 4.

This movable plate 8 is composed of a fixed unit 8-4 whose position is determined a catch cut 8-3 which catches a catch projection 3-3 of the support member 3 and a movable unit 8-7 which has a forked connection unit 8-6 connected to this fixed unit 8-4 via two folds 8-5.

At the outer end of the fixed unit 8-4, the above-mentioned connection terminal unit 8-1 is formed. The inner end 8-8 opposing this projects and is formed in the cut 8-9 of the forked connection unit 8-6 of the movable unit 8-7. The bottom surface of this inner end 8-8 is connected to the electrode 5-2 of the other (top surface) of the PTC 5.

Then, at the outer end of the movable unit 8-7, a bi-metal engaging nail 8-10 is formed in an upward and inside folded shape. Inside the neighborhood of the bi-metal engaging nail, the above-mentioned movable contact 8-2 is formed in a downward convex shape. Farther inside it, that is, close to the fixed unit 8-4, a bi-metal fulcrum projection through hole 8-11 is formed.

The bi-metal 9 is composed of two pieces of always-bent overlapped metal, and the bend is inverted at a prescribed temperature. Within the normal temperature range of use of this thermostat 1, the bend of the bi-metal 9 is convex. One end of the bi-metal 9 is caught by the bi-metal engaging nail 8-10 of the movable plate 8 to be engaged in the movable plate 8. The other end is clamped on the fixed unit 8-4 of the movable plate 8 by a clamp plate 10. Furthermore, by engaging the catch projection 3-3 in each of two catch cuts 10-1 of the clamp plate 10, the other end of the bi-metal 9 is fixed on the non-tilting top surface of the support member 3 together with the fixed unit 8-4 of the movable plate 8.

In this state, since, as described above, the bend of the bi-metal 9 is convex in the normal temperature range in use of the thermostat 1, as shown in FIG. 1, the end on the bi-metal engaging nail 8-10 side of the movable plate 8 is pushed downward by the bi-metal 9. Thus, the movable contact 8-2 at the end of the movable plate 8 is pushed to touch the fixed contact 4-2 of the fixed plate 4. In other words, the thermostat 1 as a switch is closed.

In this case, when there is a failure in the neighborhood and temperature exceeding the normal temperature range in use of the thermostat 1 is conveyed to the b-metal 9, the bend of the bi-metal 9 is inverted and the shape of the bi-metal becomes concave. Thus, the movable unit 6-7 of the movable plate 8 is lifted upward via the bi-metal engaging nail 8-10, and the movable contact 8-2 is separated from the fixed contact 4-2. As a result, the contacts are opened.

As described above, the movable plate 8 is structured so as to push the movable contact 8-2 against the fixed contact 4-2 or to separate the movable contact 8-2 from the fixed contact 4-2.

The external circuit 6 to which this thermostat 1 is connected is composed of a power supply unit 11, a load 12 and a power switch 13 and comprises the above-mentioned connection terminal 7 (7-1, 7-2), as typically shown in FIG. 1.

Figure 3:
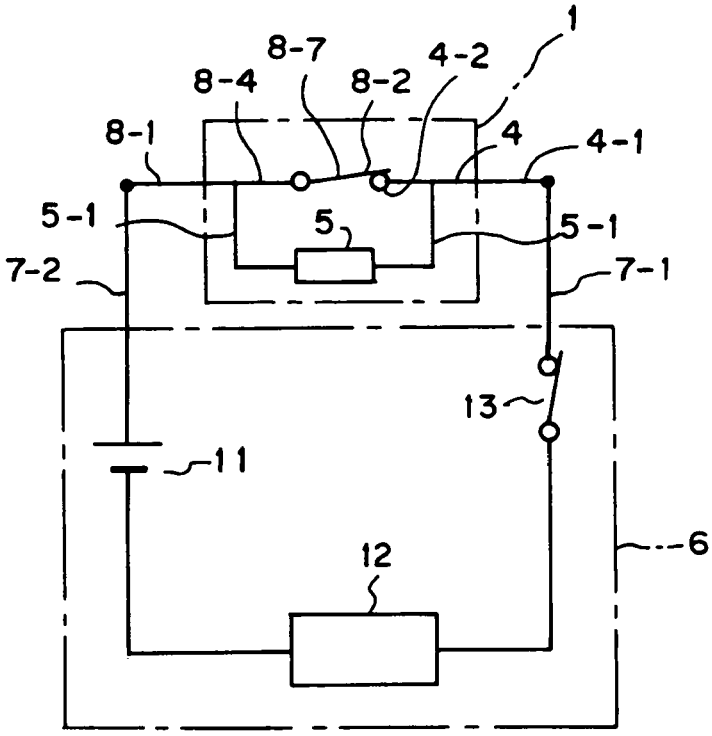
FIG. 3 is a circuit diagram showing the connection between the thermostat and the external circuit.
Figure 3:
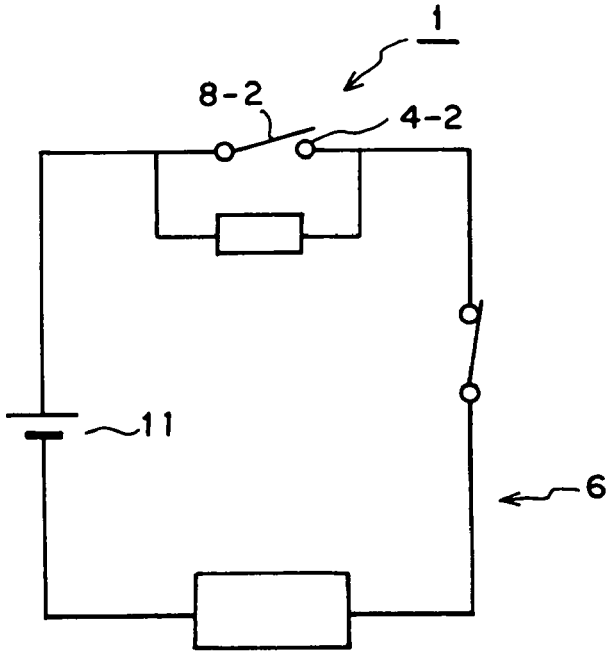

FIG. 3A is a circuit diagram showing the connection relationship between the thermostat 1 and external circuit 6 shown in FIG. 1, and FIG. 3B shows a state where the switch of the thermostat 1 is open. In FIG. 3A, the same reference numerals as used in FIGS. 1 and 2 are attached to the same components as used in FIGS. 1 and 2. Since the configuration of FIG. 3B is the same as in FIG. 3A except for that the switch is open, reference numerals are attached only to components whose description is needed, and the reference numerals of the other components are omitted.

As shown in FIGS. 3A and 3B, the PTC 5 is parallel connected to a contact circuit composed of the fixed contact 4-2 and the movable contact 8-2 via its electrodes 5-1.

As shown in FIG. 3A, when the switch of the thermostat 1 is closed, the voltage between both the electrodes 5-1 of this PTC 5 as a non-linear resistor is almost "0". Therefore, no current flows in the PTC 5 with a prescribed resistance value whose basic temperature is 25° C.

If the switch of the thermostat 1 is opened due to the change of the above-mentioned ambient conditions, as shown in FIG. 3B, even if the contact is opened, the entire circuit is a closed circuit, and accordingly, surge voltage becomes difficult to occur, since the PTC5 is inserted between the fixed contact 4-2 and the movable contact 8-2.

Since power voltage is applied to the PTC 5, the PTC 5 instantaneously generates heat, and the heat reduces it resistance value up to a value at which prescribed peak current flows based on the characteristic of the PTC 5. Therefore, surge current becomes difficult to occur.

Thus, no current flows between the fixed contact 4-2 and the movable contact 8-2 due to surge voltage. In other words, no arc occurs between the fixed contact 4-2 and the movable contact 8-2.

When current continues to flow without modifications, the PTC 5 further generates heat, and this time, the resistance value rises.

Figure 4:
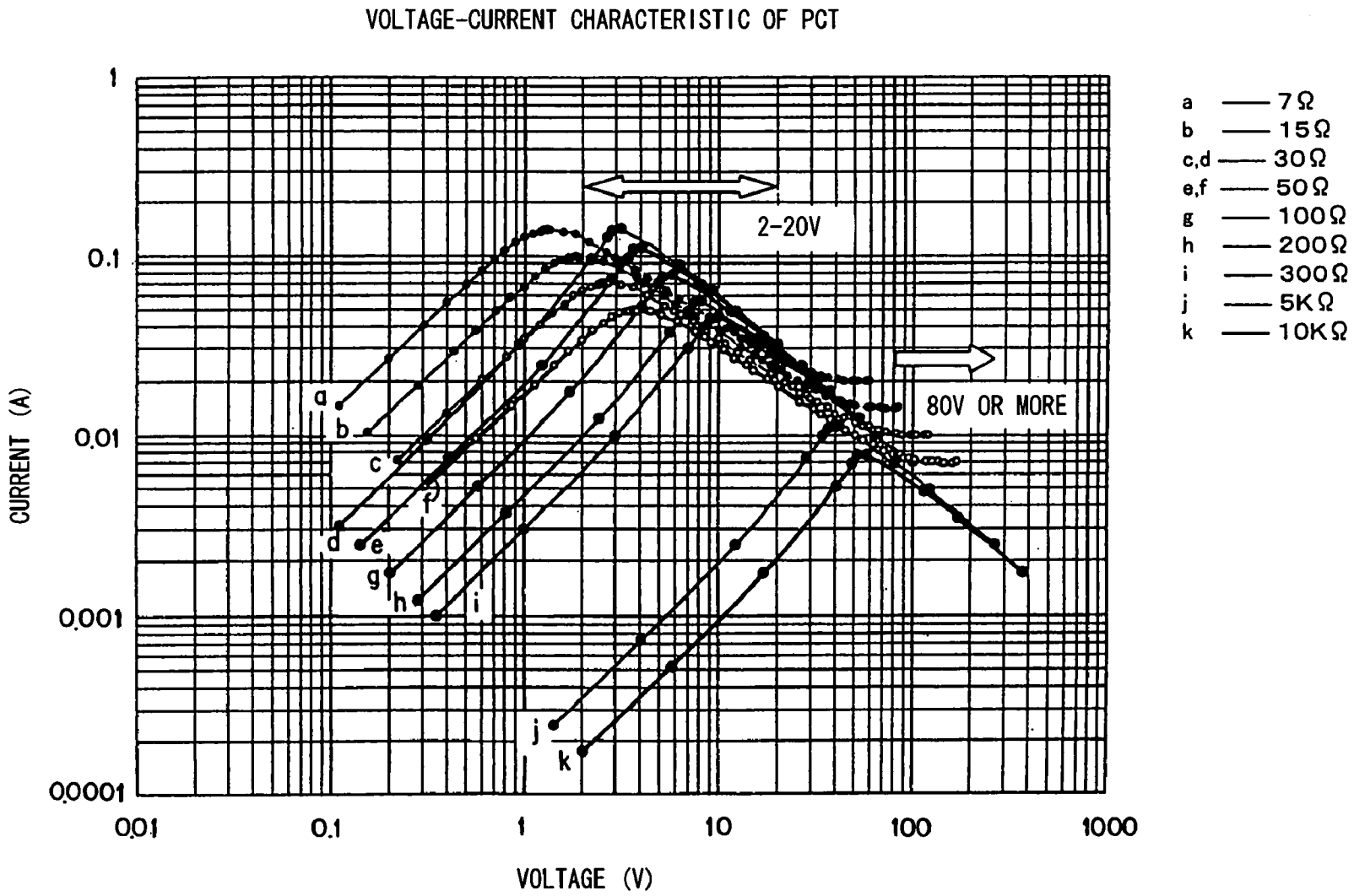
FIG. 4 is a voltage/current characteristic chart obtained by manufacturing the switch using a variety of PTCs as samples and examining the relationship between their voltage and current by experiment.

FIG. 4 is a voltage/current characteristic chart obtained by manufacturing the switch using a variety of PTCs each with a different characteristic as samples in order to obtain a PTC 5 with the above-mentioned characteristic (voltage/current characteristic), examining the relationship between their voltage and current by experiment and plotting the examination result. The horizontal and vertical axes indicate voltage (V) and current (A), respectively. The respective scales of the horizontal and vertical axes are expressed in logarithm.

FIG. 5 is a table in which the major characteristics of each PTC obtained from the voltage/current characteristic diagram are indicated by numeric values for the purpose of easy reading. The resistance value shown at the left end of each characteristic curve of the voltage/current characteristic chart shown in FIG. 4 indicates a resistance value at 25° C. This resistance value under the ambient temperature condition of 25° C. is used as a base for specifying and distinguishing a PTC, which is a non-linear resistor.

To each of the resistance values 7Ω, 15Ω, 30Ω, 50Ω, 30Ω, 50Ω, 100Ω, 200Ω, 300Ω, 5k (5000)Ω and 10k(10,000)Ω of the PTC, which are shown at the left end of each characteristic curve of the voltage/current characteristic chart shown in FIG. 4, one of sample numbers No. 1 through No. 11 is attached as shown in FIG. 5.

Here, the characteristics of a PTC, including thermal runaway, are described. As to the characteristics of a PTC, if power voltage is 100V or 200V, an initial resistance of approximately 5KΩ to 10KΩ is used. In this case, the PTC has a characteristic that a peak current position against voltage in the range where no thermal runaway occurs, in the voltage/current characteristic is 50V or more. If such a PTC is used for direct current with high voltage (30-42V), resistance reduction does not accompany an arc generated at the time of cutoff and almost the same state as when a fixed resistance is connected occurs. In this case, since voltage at each end of a thermostat, which is divided with load resistance, does not decrease so much, the arc cannot be reduced.

However, in the PTC, a peak current position against voltage in the range where no thermal runaway occurs, in the voltage/current characteristic is set in the above-mentioned voltage of direct current, that is, a value lower than 50V, power voltage higher than voltage which generates the minimum resistance value is applied to the PTC at the time of the cutoff of the thermostat. In this case, the PTC is parallel inserted between contacts for cutting off power supply, and voltage between thermostat terminals drops to voltage obtained by subtracting drop due to load from 0V in a short time.

Specifically, even if a part between the thermostat terminals is clamped by the PTC and the circuit is cut off, the circuit remains a closed circuit without an open part and transitional surge voltage becomes difficult to occur. Besides, the PTC has a section with the minimum resistance value while respective voltage at each end change, and current which flows through the PTC also has a peak.

Even in the case of fairly high resistance of 300Ω, the peak of the voltage/current characteristic is located around 10V. In this case, although current at 42V is 0.015A in this static characteristic, the current goes through a peak of 0.045A by then. Although the resistance is calculated to be the minimum resistance of approximately 222Ω, based on the graph shown in FIG. 4, in the course of cutoff, this resistance is connected to an arc and the resistance value has the minimum value. Therefore, surge voltage is difficult to occur, and the continuation of the arc is also stopped. Thus, the arc is extinguished in the course of cutoff.

However, if two 12V system batteries are connected in series, the maximum voltage is 28V. If three 12V system batteries are connected in series, the maximum voltage is 42V. When this 28V is the lower limit, it is effective if the above peak current is set in voltage lower than 28V, specifically in the range up to 20V. This capability can be increased if a resistance value is reduced. However, if excessive voltage is applied to a PTC, specifically, if voltage out of self-control is applied, current rapidly increases and enters a thermal runaway area.

Specifically, there is a point where if excessive voltage is applied to an area (lower right) in which resistance increases as voltage increases, in the voltage/current characteristic chart shown in FIG. 4, the curve turns to rise (a curve changing part on the high voltage side; although in FIG. 4, the part seems almost horizontal, in reality the right end of the part rises a little). This point is called a lower peak or a pressure marginal point. Since the PTC enters the above mentioned thermal runaway area when going beyond this point and incurs self-destruction, the point is also called a thermal runaway generating point.

Therefore, the PTC has an upper limit condition against voltage, and this upper limit condition becomes the above-mentioned lower peak (thermal runaway generating point) of the curve. At least, it is necessary to ensure safety by setting the voltage of the lower peak of this curve to twice as high as normal voltage in use, and 80V is a guide. If this condition is specified by the peak current value of the voltage/current characteristic, in a characteristic on the voltage side lower than 2V, a pressure characteristic on the high voltage side is not sufficient. Therefore, the condition can be limited to the range of almost 2V to 20V.

As shown in the field of a lower peak position 14-5 in the table 14, as to samples No. 1 and No. 2 shown in FIG. 5, the lower peak position is lower than 2V, and its pressure characteristic on the high voltage side is not sufficient, since safety at voltage in use is not secured as described above. Therefore, samples No. 1 and No. 2 are excluded from targets to be adopted.

The position (V) of peak current shown in the field of peak current position 14-4 indicates the position of voltage, in which the initial current which flows through a PTC becomes the maximum. It is better for current flowing through the PTC 5 immediately after the switch shown in FIG. 3B to be the maximum. In order to maximize current which flows through the PTC 5 immediately after the switch, the position (value) (V) of peak current should be as small as possible, since voltage applied to the PTC 5 immediately before the switch shown in FIG. 3A is almost "0".

Then, since samples No. 1 and No. 2 are already excluded, the remaining samples No. 3 through No. 11 are checked. As a result, since it is found that the respective position (values) (V) of peak current of samples No. 3 through No. 9 are one digit and the respective positions (V) of peak current of samples No. 10 and No. 11 are higher than voltage in use (in this example, 48V or less), samples No. 10 and No. 11 are excluded from targets to be adopted. Therefore, only samples No. 3 through No. 9 remain as targets to be adopted.

Thus, it is determined that PTCs which do not cause thermal runaway at target voltage (48V or less) and can be safely used are samples No. 3 through No. 9. Each of such PTCs has a voltage/current characteristic whose position of peak current is located in the range of 2V to 20V.

In the field of a lower peak position 14-5 of the table 14 shown in FIG. 5, any of the respective lower peak positions of samples No. 3 through No. 9 is located between 60V and 170V, that is, 42V or more. More particularly, since each of the respective lower peak positions of the PTCs of samples No. 3 through No. 5 is 80V or more, which is almost twice the rated voltage 42V of the above-mentioned power supply unit, each of them has a preferable characteristic. It is found that each of them is suitable as a PTC 5 to be parallel connected to the external circuit 6, as shown in FIGS. 3A and 3B as the switch of the thermostat 1.

In FIG. 5, since more particularly, each of the respective lower peak positions of samples No. 3 and No. 4 is located between 110 V and 170V, it is found they are suitable even if the rated voltage of the power supply unit is 50V.

A PTC has the start point of a temperature area in which a resistance value suddenly increases, and this temperature is called Curie temperature (Tc). This temperature is defined as temperature corresponding to a resistance value twice as much as the minimum resistance value. The minimum resistance value is the position (V) of peak current shown in FIG. 5.

Therefore, it is necessary to select and adopt one whose Curie temperature is set to a value higher than operating temperature from the samples No. 3 through No. 9 so as to pass through the minimum resistance area before it operates and its contacts are opened.

A desired PTC can be obtained by changing not only its above-mentioned voltage/current characteristic but also its temperature characteristic.

Figure 6:
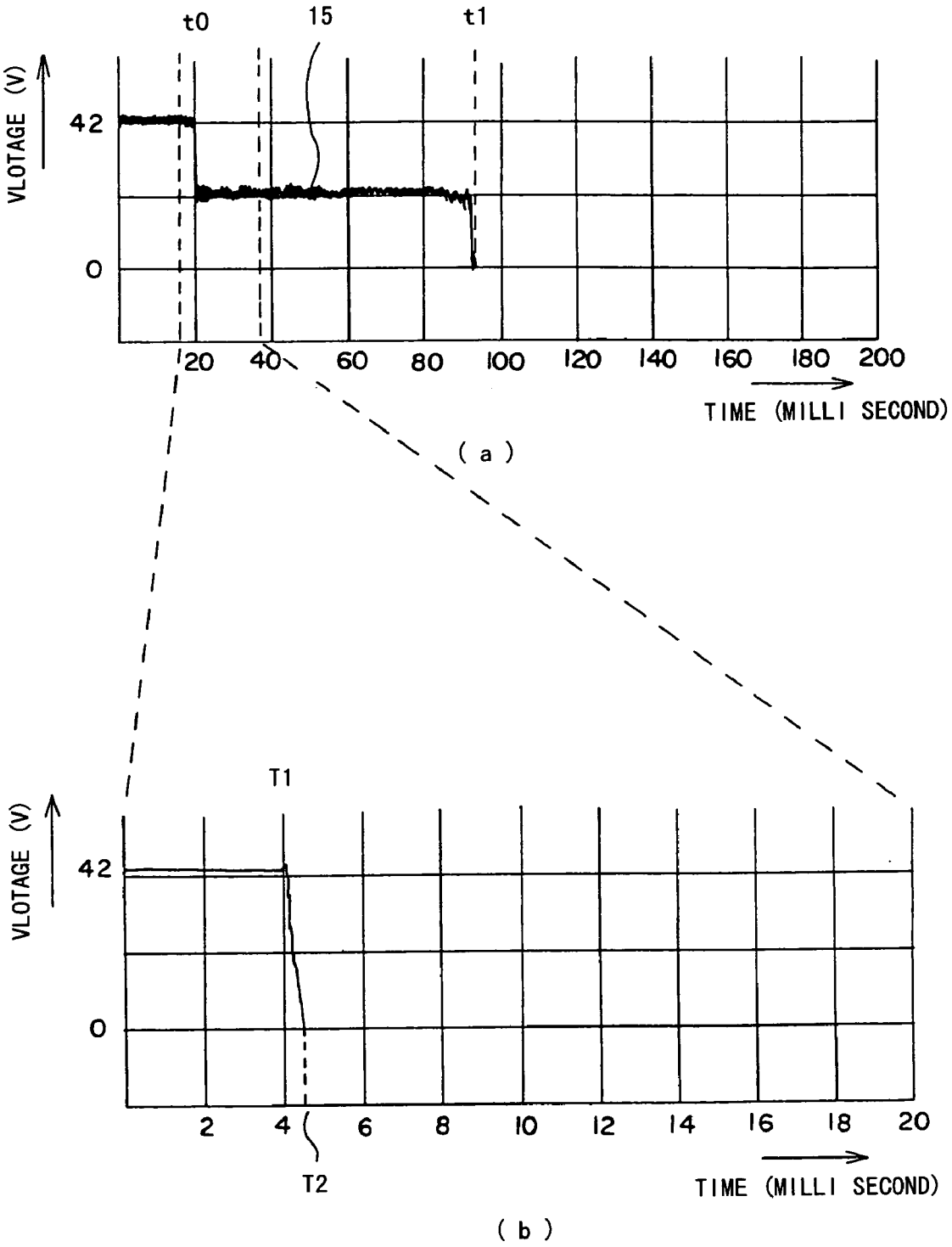
FIG. 6A shows changing current obtained when cutting off 42V current by the conventional thermostat in which PTCs are not provided for the purpose of comparison.
FIG. 6B shows changing current obtained when cutting off 42V current by the thermostat of the present invention, in which PTCs are provided.

FIG. 6A shows changing current obtained when cutting off 42V current by the conventional thermostat in which PTCs are not provided for the purpose of comparison, and FIG. 6B shows changing current obtained when cutting off 42V current by the thermostat of the present invention, in which PTCs are provided.

In FIGS. 6A and 6B, the horizontal and vertical axes indicate time and voltage, respectively. The unit time scales on the horizontal axis of FIGS. 6A and 6B are 20 milli-seconds and two milli-seconds, respectively.

In FIG. 6A, 70 milli-seconds and a little time elapse between time t0 when the contacts of a switch are opened and 42V current is cut off, and time t1 when current is completely cut off between the contacts and voltage becomes 0 (in this case, it means hereinafter that current is 0). Specifically, during this period, an arc 15 occurs between the contacts, and the generation of the arc 15 continues for 70 milli-seconds or more. If an arc continues to occur for 70 milli-seconds or more, contacts easily melt down, are short-circuited by fusion or the like, and a switch is destroyed.

However, in the example shown in FIG. 6B, only one milli-second elapses between time T1 when the contacts of a switch are opened and 42V current is cut off, and time T2 when current is completely cut off between the contacts and voltage becomes 0. In other words, the switch of the present invention can certainly cut off high-voltage direct current 70 or more times as fast as the conventional switch. Furthermore, since no arc occurs, no contacts melt, and the life of the switch is remarkably extended.

Although in the above-mentioned preferred embodiments, the description is made using a thermostat as an example, the switch is not limited to a thermostat, and for example, an electromagnetic relay can also be used. Another preferred embodiment using an electro-magnetic relay as the switch is described below.

Figure 7:
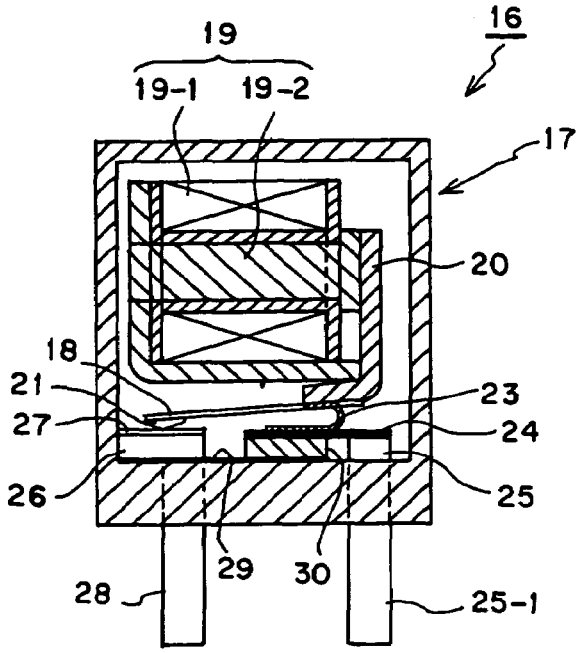
FIG. 7 is the sectional side view of the electromagnetic relay in another embodiment of the present invention.
Figure 7:
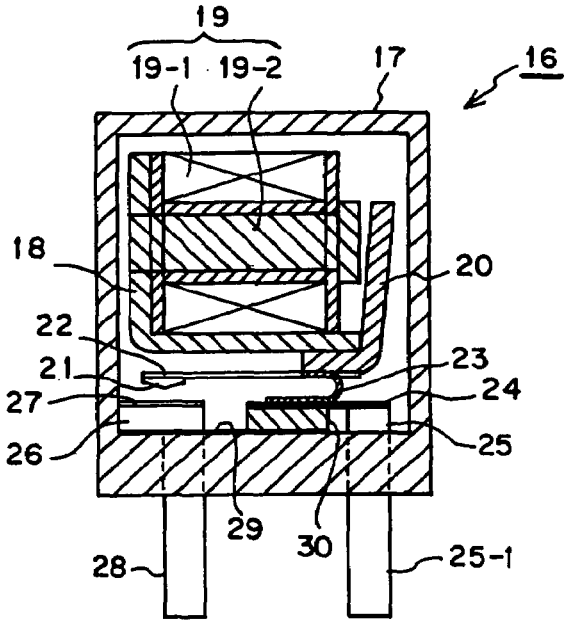

FIGS. 7A and 7B are the sectional side views of an electro-magnetic relay in another embodiment of the present invention. FIG. 7A shows its open contact state, and FIG. 7B shows its closed contact state. The electromagnetic relay 16 as the direct current cutoff switch as shown in FIGS. 7A and 7B is supported by a support member 18 which occupies most of the interior of a housing 17. An electro-magneto 19 composed of a coil 19-1 and a core 19-2 is provided.

One end of the long hooked shaft of a movable member 20 whose section is shaped like a hook is opposed to the attractive end of the core 19-2. A movable contact 21 is provided for the other end of the short hooked shaft of the movable member 20 via a support arm 22. Furthermore, a connection terminal unit 25 is provided for and electrically connected to the same other end of the short hooked shaft via a spring 23 and a connection plate 24. The connection terminal 25-1 of the connection terminal unit 25 projects outside through the base of the housing 17.

A fixed contact 27, which is provided on the top surface of a fixed member 26, is provided under the movable contact 21 opposing it. The fixed member 26 comprises a connection terminal unit which passes through the base of the housing 17 and projects outside. The fixed member 26 further comprises a connection plate 29, which is disposed close to the inner base surface of the housing 17. A PTC 30 is inserted between this connection plate 29 and a connection plate 24 electrically connected to the movable contact 21 via the support arm 22 and the spring 23. The connection plates 24 and 29 are connected to the electrode on the top and bottom surfaces, respectively, of the PTC 30.

If the electro-magneto 19 is energized and driven, as shown in FIG. 7A, this electro-magnetic relay rotates counter-clockwise using the boundary between the long and short shafts as a fulcrum by attracting one end of the long shaft to the attraction end of the core 19-2. Thus, the movable contact 21 is pressed on the fixed contact 27.

By connecting the connection terminals 28 and 25-1 to the connection terminals 7-1 and 7-2, respectively, of the external circuit 6 shown in FIG. 1 in this state, the same circuit as shown in FIG. 3A can be formed.

If the current to the electro-magneto 19 is cut off, the movable contact 21 is separated from the fixed contact 27 and both the contacts are opened by pushing the movable member 20 clockwise using the boundary between the long and short shafts by the pushing force of the spring 23. In this case, the same circuit as shown in FIG. 3B is formed.

Since the PTC 30 is parallel connected to a contact circuit composed of the movable contact 21 and the fixed contact 27, in this case too, no arc occurs between the opened movable contact 21 and fixed contact 27, current is cut off at least within two milli-seconds.

If an initial resistance of approximately 5KΩ to 10KΩ is used, as shown in samples No. 10 and No. 11, a peak current position against voltage in the range where no thermal runaway occurs, in the voltage/current characteristic is 50V or more. If such a PTC is used for direct current with high voltage (30-42V), resistance reduction does not accompany an arc generated at the time of cutoff and almost the same state as a fixed resistance is connected occurs. Therefore, an arc cannot be reduced without reducing the voltage of the switch. However, it is true only when a PTC is used at high voltage of 30V to 42V.

If an initial resistance of approximately 5KΩ to 10KΩ is used, as shown in samples No. 10 and No. 11, the position of peak current is located in the range of 40V to 60V, and a lower peak is located in the range of 250V to 350V. Therefore, for high direct current voltage of 140V to 300V obtained by rectifying AC mains power voltage used inside equipment, a PTC can be parallel connected to the switch in the same way as in samples No. 3 through No. 9 (preferably up to No. 5) against high voltage of 30V through 42V, and the same effect can be obtained.

INDUSTRIAL APPLICABILITY

As described above, the direct current cutoff switch of the present invention is used to reduce the occurrence time of an arc at the time of opening contacts of a high-voltage current circuit, prevent the contacts from melting down and reduce damage. The present invention can be used in all industries using a direct current cutoff switch for cutting off direct current.

The invention claimed is:

1. A direct current cutoff switch which is provided with a conductive fixed member and a movable member between which a dielectric member is inserted, said fixed member comprises a fixed contact which is formed in a prescribed position and is connected to a terminal in order to be connected to an external circuit, and said movable member comprises a movable contact which is formed on a position opposing the fixed contact, is connected to a terminal in order to be connected to the external circuit and is structured so as to push the movable contact against the fixed contact or open the contacts, for cutting off direct current which flows between the terminals connected to the external circuit by operating the movable contact so as to separate it from the fixed contact which the movable contact touches to open the contacts, comprising:

a non-linear resistor which takes an arbitrary pillar shape, comprises an electrode on each of the top and bottom surfaces, and is parallel connected to a contact circuit composed of the fixed and movable contacts via these electrodes, said non-linear resistor has a resistance fluctuating area indicating the minimum resistance value while inter-contact voltage shifts from 0V to power voltage when the direct current is cut off by the opening of the movable contact, wherein said non-linear resistor is a positive temperature coefficient (PTC), and contact opening voltage at the time of the cutoff of the large direct current by the opening of the movable contact is in the range of 28V to 48V, wherein said PTC has a voltage/current characteristic that upper-limit voltage in a range where no thermal run-away occurs or a lower peak is 80V or more, and wherein said PTC has a voltage/current characteristic that the position of peak current against voltage in a range where no thermal runaway occurs is located in a range of 2V to 20V.

2. The direct current cutoff switch according to claim 1, wherein said external circuit is a circuit with rating of direct current 42V or a circuit for driving induction load.

3. The direct current cutoff switch according to claim 1, wherein said movable member is driven by a bi-metal, and said external circuit is a charging side circuit of a 28V or more secondary battery pack or a charging/discharging circuit, and a rated circuit whose opening voltage generated by the opening of the movable contact at the time of charge or at the time of charge/discharge does not exceed 50V.

4. The direct current cutoff switch according to claim 3, wherein in said PTC, Tc (Curie temperature) is set to a value higher than the operating temperature of the bi-metal.

5. The direct current cutoff switch according to claim 1, wherein said movable member is driven by an electro-magnetic coil.

6. The direct current cutoff switch according to claim 1, wherein said non-linear resistor is provided between the fixed contact or movable contact and the connection terminal unit, and prevents an arc generated between contacts at the time of the opening of the movable contact from continuing for two milli-seconds or more.

* * * * *